US005868222A

United States Patent [19]

Charbonneau

[11] Patent Number: 5,868,222

[45] Date of Patent: Feb. 9, 1999

[54] LADDER STABILIZERS

[76] Inventor: Francois Charbonneau, 1228 O'Diana West, Lachenaie, P. Quebec, Canada, J6X 4H1

[21] Appl. No.: 668,060

[22] Filed: Jun. 10, 1996

[30] Foreign Application Priority Data

Jan. 18, 1995 [CA] Canada ..... 2 118 436

[51] Int. Cl.[6] ..... E06C 1/00

[52] U.S. Cl. ..... 182/172; 182/107; 182/200; 248/354.5

[58] Field of Search ..... 182/107, 172, 182/200; 403/109, 377, 378; 248/188.4, 351, 354.5

[56] References Cited

U.S. PATENT DOCUMENTS

| | | | |
|---|---|---|---|
| 1,442,694 | 1/1923 | Martin | 182/172 X |
| 3,508,628 | 4/1970 | Conrad | 182/172 |
| 3,856,112 | 12/1974 | Stewart | 182/172 |
| 4,519,477 | 5/1985 | Ralston | 182/200 X |
| 4,899,849 | 2/1990 | Levi et al. | 182/172 |
| 4,949,809 | 8/1990 | Levi et al. | 182/172 |
| 5,116,004 | 5/1992 | Luecke | 248/188.4 X |
| 5,148,892 | 9/1992 | Lu | 248/188.4 X |
| 5,267,631 | 12/1993 | Mendel | 182/107 |
| 5,423,397 | 6/1995 | Boughner | 182/107 |

FOREIGN PATENT DOCUMENTS

| | | | |
|---|---|---|---|
| 533952 | 6/1958 | Belgium | 248/354.5 |

*Primary Examiner*—Daniel P. Stodola
*Assistant Examiner*—Richard M. Smith

[57] ABSTRACT

Ladder stabilizers for lateral attachment to an extension ladder for inhibiting sideways slipping and falling thereof accordingly to full safety. A long tube support made from non-rusting, a non-articulated bracing member, and a ladder side rail form an A-frame with the tube support and the side rail comprising the legs of the A and the bracing member comprising the horizontal connecting member of the A. The lock for the telescoping sections visibly indicates they are locked, this as per American National Standard ANSI A14.2-1990, par. 6.7.10, the installation being fully secured because of the technically safe locking device the telescopic tube is blocked with a spring pin. Ladder stabilizers are telescopic tubes for uneven ground and are pivotable along only the same surface of the ladder, thus enlarging the sustentation polygon for ladder support. For storage position, horizontal braces are detached and rotate about a metal attachment on the side rail of the ladder to become parallel with the ladder, the telescopic tubes are also in the same position and are firmly tied with a tension hook. This ladder stabilizer is to be added to any existing ladder extensible or non-extensible.

1 Claim, 3 Drawing Sheets

12
11
1
4
9
8
6
7
5
2
3
21
22
10
X
Y
X
Y

LADDER STABILIZERS

FIELD OF THE INVENTION

This invention relates to the field of climbing ladders and is specially concerned with a set of pivotable lateral ladder supporting legs adapted to provide stabilizing means by enlarging the sustension polygone, the legs acting as structural braces to the ladder.

DISCUSSION OF THE PRIOR ART

There is disclosed in the prior art the use of telescopic stabilizing legs fastened to the ladder at a location near the lowermost ladder section. The Levi & Quarberg U.S. Pat. No. 4,899,849 describes such stabilizers which are not technically safe, then this patent should have never been accepted, thus the definition of the Pat. was to provide a secured ladder stabilizing mean. The reasons are critical, first when a user has to climb higher than the upper connected hinge block, the ladder will react like a balancer tending to be only supported by the new stabilizer legs, thus eliminating the important friction force of the original two legs of the ladder. Also, the telescopic sections of the leg are secured by a cam lock system which does not visibly indicate whether the telescopic sections are locked or unlocked, no one can assure a firm safe locking strength from the cam which could be loose and the ladder user not knowing about it. Furthermore, any folding brace system is dangerous once the ladder is slightly tipping to one side, the opposite side automatically tends to have a bent folding brace. After the ladder is back to the vertical, this bent brace is not working at all along horizontal forces, thus bringing hazard on the main telescopic leg condemned to support the total load.

To applicant's knowledge, no one has yet invented an effective stabilizing system for an extension-type ladder. While the Leiser U.S. Pat. No. 2,149,781 and the Zumbaum U.S. Pat. No. 3,012,628 depict an attachment designed for use with ladders to provide bracing of the ladder against lateral movement, it is not particularly effective because of the point at which the stabilizing legs are attached to the ladder rails. Moreover, the mechanism used to join the stabilizing legs to the rails is difficult to use in practice specially because of different type of side rails and does not afford convenient storage when the ladder is not in use.

Another Levi & Quarberg U.S. Pat. No. 4,949,809 classified among ladder stabilizers is only to refer on extendable pole locking mechanism for ladder stabilizer even if the main drawing of the patent is showing some ladder stabilizer. Again this mechanism is not technically secured and does not visibly indicate whether it is locked or unlocked, no one can be sure if the locking ring is positioned at the right place for a safe locking device. Also, the mechanism is very complex and costly to fabricate, rendering this system unaffordable to ladder users.

Another Conrad U.S. Pat. No. 3,508,628 shows ladder stabilizers with a very complex telescoping lock mechanism which would be safe only during the time the spring on the handle is working properly, this time is very short because the spring is always stretching preventing the handle from opening and letting free the telescopic movement. Also, the side rails of the ladder are a lot different from the conventional ladder side rails, the connections of the stabilizer pole with the ladder being constructed accordingly.

Another Osborne Canadian Patent No. 1,300,578 shows ladder stabilizer with a very complex construction from which the levelling height will not be more than a couple of inches, forcing the installation to be very quickly unstabilized on uneven ground. Also, in storage position, the lateral buttressing member will not stay fixed because it will rotate around the locking pin. Another problem is vibration when climbing a ladder while locking pin will have a tendancy to fall easily on the ground.

There exist a multiple of previous patents describing devices for stabilizing climbing ladders. However, these devices have proven to be inefficient.

Accordingly, an object of this invention is to provide a climbing ladder stabilizing means which will conform to conventional forms of manufacturing be of simple construction and easy to use as to provide a climbing ladder stabilizing means which will be economically feasible, long lasting and relatively trouble free in operation.

SUMMARY OF THE INVENTION

The foregoing features and advantages are achieved by providing top support attachment between the ladder side rails and the top of the tubular support leg, and a bottom support attachment between ladder side rails and lateral straight braces. The invention is further characterized by including lateral pivotable, telescopic metallic tube supports made in two sections, top and bottom, and forming an A shape with the ladder. The support is to reach ground elevation using two tubes sliding one into the other longitudinally and telescopically for uneven ground surface. These top and bottom tubes of each side support are secured by the ladder user who must install a spring lock pin into one of the several equally spaced holes to lock tube from telescopic movement.

Furthermore, a non-folding brace is permanently attached at one end to the ladder side rails using a support attachment, and the other end is connected to the tube support by using the same spring lock pin to secure the two tube sections together on one leg support. An adjusting ring could be added on the bottom tube section for fine tuning. At the lower end of the bottom leg section is a non-sliding footpad which will follow the same angle of the leg support with ground.

When the ladder with the attached support legs is to be stowed, the support legs are folded against the ladder side rails with the lateral braces, the tubing snapping on a spring clip for storage purpose. When the ladder is to be used in its desired vertical inclined orientation, the support legs are then unfold sideways to create a surface with four legs polygon with the two original legs of the ladder. The foregoing features and advantages of the invention will become more apparent from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
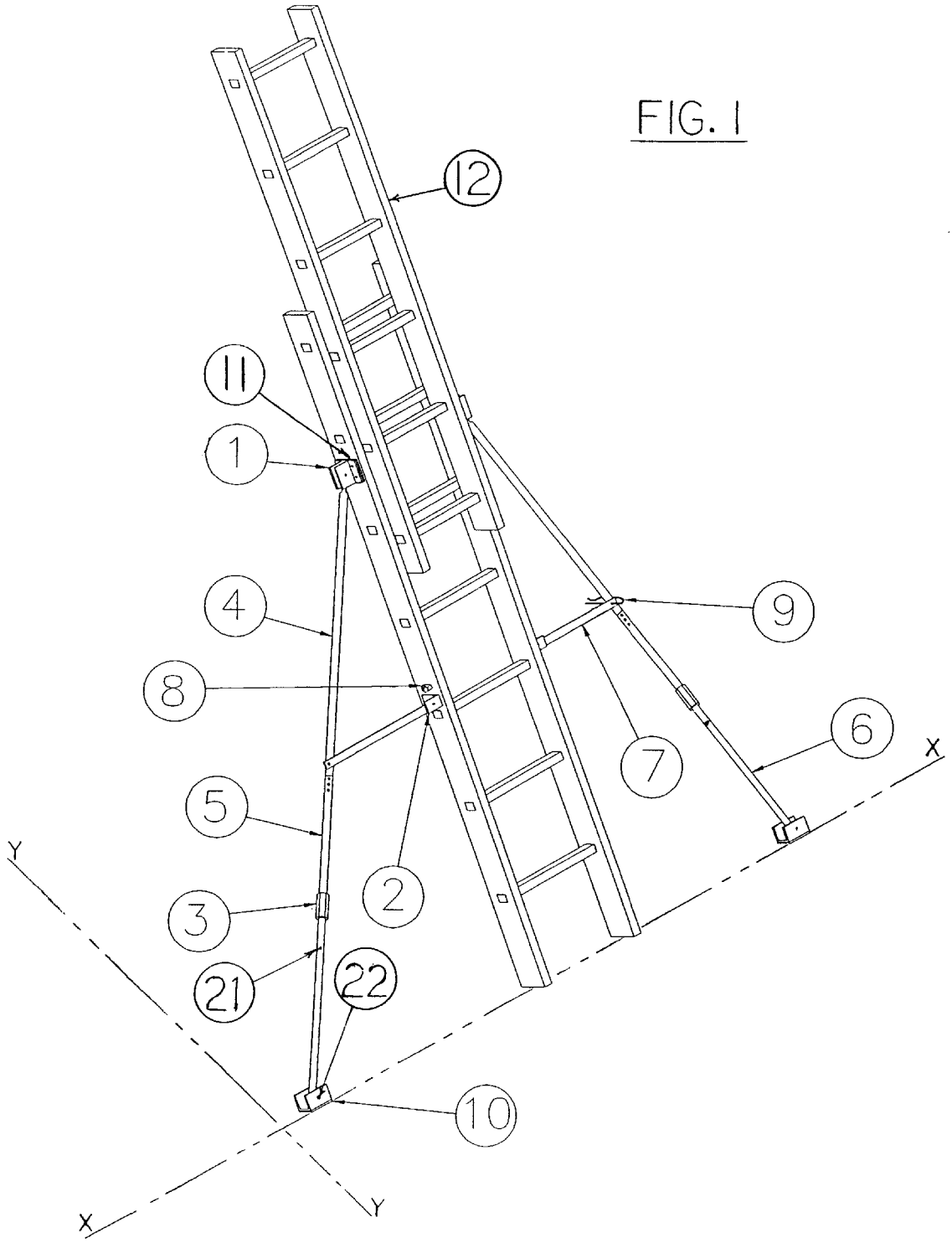
FIG. 1 is a perspective view of an extension ladder incorporating the two leg supports assembly of the present invention.
Figure 2:
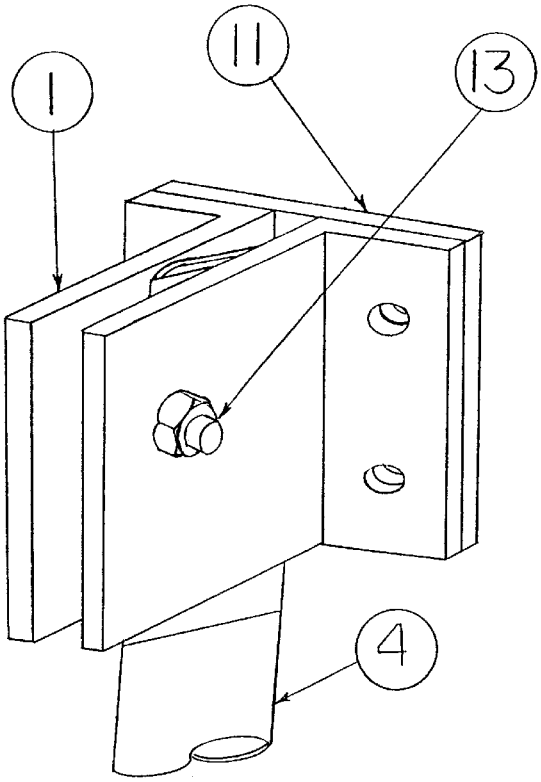
FIG. 2 is a drawing of the top support attachment for top tube supports.

In accordance with the invention, to the ladder 12 in FIG. 1 is attached to the almost upper end of lowermost section of the ladder a spacer template 11 for bolting pattern to the ladder side rails and a support attachment 1, the detailed configuration of which is best seen on drawing in FIG. 2.

Referring to FIG. 2 fitted into the U-shaped spacing of support attachment 1 is a flattenned end of top tubing 4 which is drilled for receiving a hinge pin 13 or bolt connection to allow rotation only about one axis.

Figure 3:
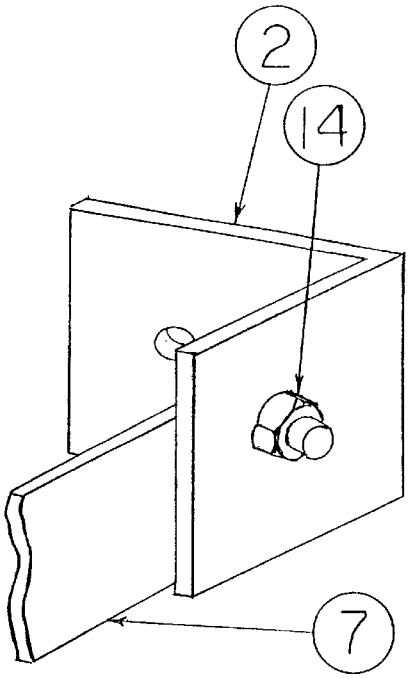
FIG. 3 is a drawing of the bottom support attachment for straight lateral brace.
Figure 5:
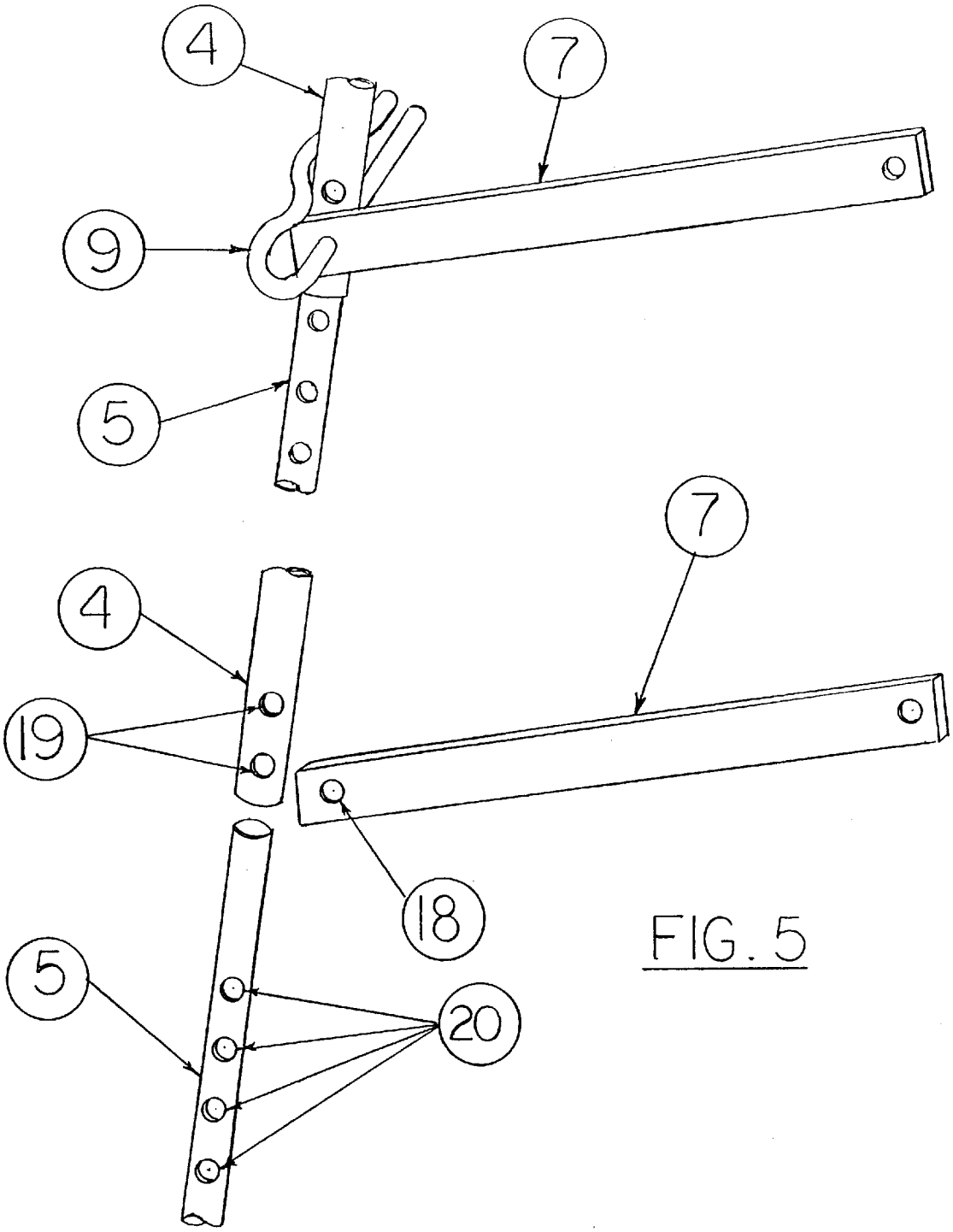
FIG. 5 is a drawing of the straight lateral brace and the spring lock pin showing the connection with the telescopic tube support.

Referring to FIG. 1 and 3, the bottom support attachment 2 is attached to the ladder side rails by bolting or riveting. This support attachment has a hinge pin 14 or bolt to allow vertical rotation of straight lateral brace 7, see details on FIG. 5, which is also connected to the top 4 and bottom 5 telescopic tubes at the same time in the same hole using spring lock pin 9. It is important to mention that spring lock pin 9 is only installed by ladder user when using the ladder for his own utility. FIG. 5 refers how this connection is being assembled.

Further enhancing the ability to stabilize the ladder is the use of non-sliding footpads 10 in FIG. 1, which will be oriented at a perfect angle to allow a best friction grip on the ground. The footpad is attached to the bottom tube 6 by the use of hinge pin 22 or one bolt connection to allow rotation along the leg support space angle.

Figure 4:
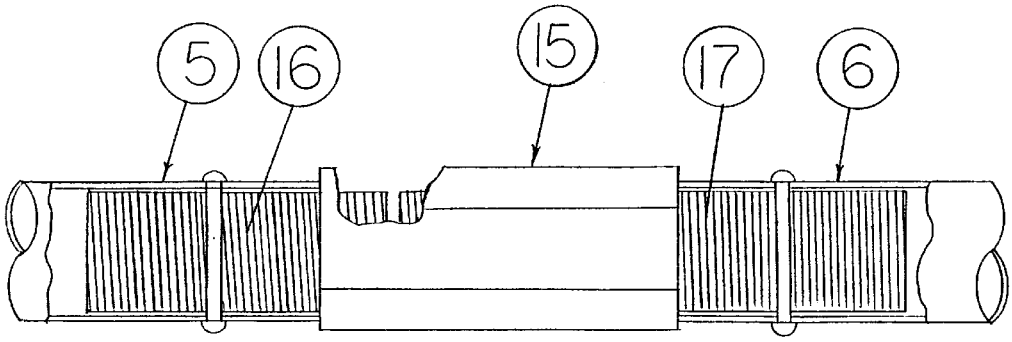
FIG. 4 is a detailed cross-sectional view of the adjustment ring.

Now referring to FIG. 1 and 4, is the detailed drawing of adjusting ring 3 for fine adjustment to the length of the leg support. The adjusting ring 3 is made of a threaded rod coupler 15 and short threaded rods 16 and 17 which are connected to tubing supports 5 and 6 by bolting or riveting. Either short threaded rod 16 or 17 is to be glued with five to six internal fillets from threaded rod coupler for secured connection.

From mounting to storage position, spring lock pin 9 is first removed from the three holes connection shown on FIG. 5, hole 18 from lateral brace 7, one of the holes 19 from top tube support 4 and one of the holes 20 from the bottom tube 5. Then lateral brace 7 and the leg support assembly 4, 5, and 6 in FIG. 1 will collapse against the ladder rails. The tubing support can be fastened to the ladder side rail using an attachment 8 when being transported or stored. The brace 7 which is then parrallel to support tubings 4, 5 and 6, is secured into support tubing 6 using spring lock pin 9 as locking mechanism in hole 21 of FIG. 1.

This invention has been described herein to provide those skilled in the art with the information needed to apply the novel principles. However it is to be understood that the invention can be carried out by specially different equipment and devices, and various modifications can be accomplished without departing from the scope of the invention itself.

It is claimed:

1. A ladder stabilizer in combination with a ladder, comprising:

a ladder comprising two side rails and a plurality of rungs; two first metal support attachments connected one each to the side rails; two second metal support attachments connected one each to the side rails at a location below the first metal support attachments; two lateral non-articulated brace members connected one each at one end to the second metal support attachments by a hinge pin allowing rotation about only one axis, each brace member having a hole at the end adjacent one of the side rails and having a hole at an end distal from one of the side rails; two upper tube supports each having a flattened upper end, said upper ends connected one each to the first metal support attachments by a hinge pin allowing rotation about only one axis; two lower tube supports telescopically slidable within the upper tube supports, the upper and lower tube supports each comprising a plurality of holes for telescopic adjustment; two spring lock pins each simultaneously passing through an intersection of one of the holes in one of the upper tube supports, one of the holes in one of the lower tube supports, and the distal hole in one of the brace members; an adjusting ring which adjusts the length of the lower tube support; and a shoe pad pivotally attached at a bottom end of the lower tube support.

* * * * *